US005915579A

United States Patent [19]

Przytulla et al.

[11] Patent Number: 5,915,579

[45] Date of Patent: Jun. 29, 1999

[54] CONTAINER WITH TAMPER-EVIDENT AND PRE-LOCKABLE CLOSURE ASSEMBLY

[75] Inventors: Dietmar Przytulla, Karpen; Alfons Mulder, Bornheim; Khaled Atta, Erftstadt, all of Germany

[73] Assignee: Mauser Werke GmbH, Brühl, Germany

[21] Appl. No.: 09/060,005

[22] Filed: Apr. 14, 1998

Related U.S. Application Data

[63] Continuation-in-part of application No. 08/716,382, Sep. 19, 1996, abandoned.

[30] Foreign Application Priority Data

| | | | |
|---|---|---|---|
| Feb. 13, 1995 | [DE] | Germany | 295 02 309 |
| Feb. 10, 1996 | [WO] | WIPO | PCT/EP96/00594 |
| Apr. 14, 1997 | [DE] | Germany | 297 06 672 |

[51] Int. Cl.[6] ..... B65D 41/34

[52] U.S. Cl. ..... 215/252; 215/330; 215/331

[58] Field of Search ..... 215/252, 330, 215/331

[56] References Cited

U.S. PATENT DOCUMENTS

| | | | |
|---|---|---|---|
| 4,936,474 | 6/1990 | Szczesniak et al. | 215/330 X |
| 5,027,964 | 7/1991 | Banich, Sr. | 215/252 |
| 5,346,082 | 9/1994 | Ochs et al. | 215/252 |
| 5,450,972 | 9/1995 | Zemlo | 215/252 |
| 5,667,088 | 9/1997 | King et al. | 215/252 |
| 5,794,803 | 8/1998 | Sprick | 215/330 X |
| 5,803,287 | 9/1998 | Kusz | 215/331 X |

*Primary Examiner*—Stephen K. Cronin
*Assistant Examiner*—Nathan Newhouse
*Attorney, Agent, or Firm*—Henry M. Feiereisen

[57] ABSTRACT

A container has a neck formed with projections and a closure assembly for attachment to the neck and movable between a fully released position and a fully closed position. The closure assembly includes a screw cap and an index ring which serves as tamper-evident safety mechanism and is connected to the screw cap via several thin bridge portions forming predetermined breaking points and torn off when the screw cap is released from its fully closed position for the first time for the first time. The neck and the index ring are formed with mutually engaging locking elements (ratchets 36, flexible tongues 34) which are so moved that a tightening of the screw cap from the fully released position into an intermediate position results in at least two of the first locking members of the index ring to engage with the second locking members such that a spontaneous unscrewing and release of the screw cap is prevented while still allowing unscrewing of the screw cap by overcoming a certain retention force applied by the first locking members.

18 Claims, 8 Drawing Sheets

FIG. 5
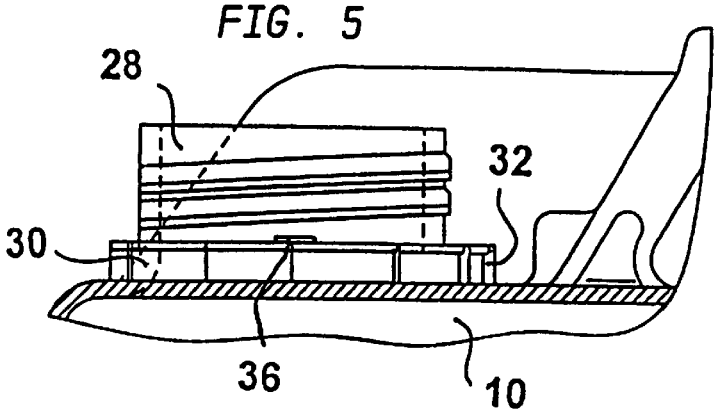
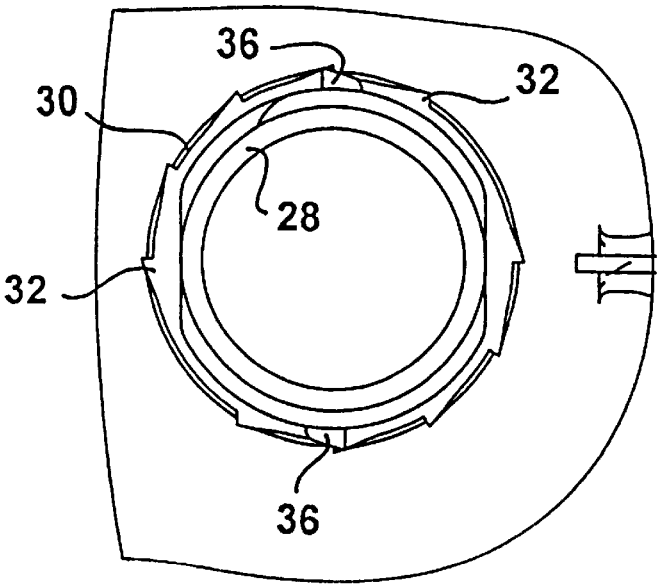
FIG. 6
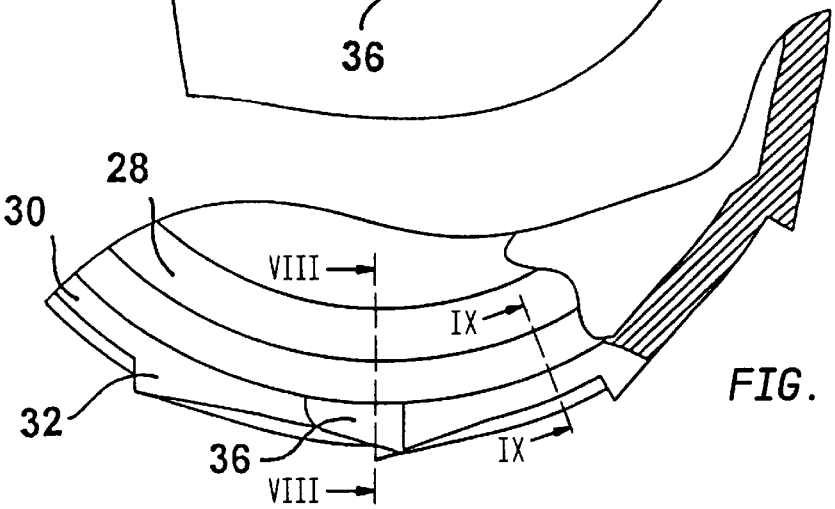
FIG. 7
FIG. 8
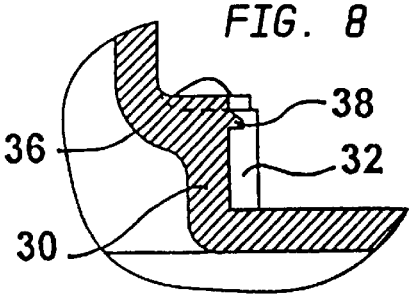
FIG. 9
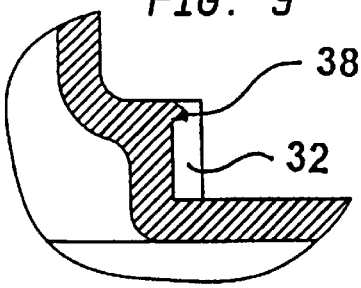

CONTAINER WITH TAMPER-EVIDENT AND PRE-LOCKABLE CLOSURE ASSEMBLY

This is a continuation-in-part of patent application Appl. No. 08/716,382, filed Sep. 19, 1996 now abandoned.

BACKGROUND OF THE INVENTION

The present invention relates to a container with tamper-evident and pre-lockable closure assembly, and in particular to a container with a screw cap of a type having attached thereon an index ring to provide an authenticity seal, and being provided with snap-in projections on the outside of a raised container neck forming the inlet or outlet opening, with flexible tongues disposed on the index ring engaging non-detachably behind the snap-in projections in such a way that several thin bridge portions formed between the screw cap and the index ring and serving as predetermined breaking points are severed when the screw cap is unscrewed.

The container may be a sheet metal container, for example a pail made of tinplate with a fill and drain opening in the cover or a container made of sheet steel; the container may preferably also be manufactured from plastic material and serve as a container for mineral oil made by blow-molding; a hobbock, a fassett, a storage container, or a plastic container, such as e.g. a bunged drum or a wide-necked drum (lidded drum) having a drum lid and a tension ring closure. Such containers have at least one fill and drain opening in their top bottom or in a separately attached lid which is closed off by a screw cap. The screw cap may be formed e.g. for a bunged drum or for a drum lid with a bunghole, as a bung plug.

It is known to provide screw caps for canisters with a separate, prefabricated push-on index ring serving as tamper-evident safety mechanism which breaks along predetermined breaking points in form of thin bridge portions when the screw cap is released and unscrewed for the first time. This is disadvantageous because the index ring requires provision of a separate mold for carrying out the separate injection molding process. The index ring must be attached separately and may fall off e.g. upon handling during the filling operation, i.e. the index ring is not reliable for automatic handling.

Also known are screw caps for canisters with integrally molded index ring; these screw caps, however, are made of plastics of low or intermediate molecular weight exhibiting inferior mechanical strength at low temperatures. As a consequence, these screw caps did not succeed in an industrial environment since they do not pass approved standards for a drop test at low temperatures.

All known constructions have the further disadvantage that the loosely attached screw cap may become detached as a result of shocks and vibrations during transport from the manufacturer to the filling station and may get lost. Consequently, there is no guarantee that an absolute seal against dust can be maintained e.g. during transport by a truck. In known designs, the authenticity ring or index ring does not remain attached to the neck after the screw cap is removed, and can therefore drop into the subjacent container when emptying the liquid content into a lower container to be filled, i.e. when the container is tilted. Also, a secure locking of the authenticity ring cannot be ensured during attachment of the screw cap, and the bridge portions between screw cap and index ring alone have to absorb the uneven circumferential load on the authenticity ring (during sequential breakage of the bridge portions) when the screw cap is tightened or unscrewed.

SUMMARY OF THE INVENTION

It is thus an object of the present invention to provide an improved container, obviating the afore-stated drawbacks.

In particular, it is an object of the present invention to provide an improved container which is so designed as to effect a secure pre-locking of the closure assembly, thereby ensuring a protection from dust during transport.

It is still another object of the present invention to provide an improved container with improved tamper-evident and pre-lockable closure assembly which enables a better detachment of the authenticity ring from the screw cap and a subsequent secure retention of the torn-off authenticity ring on the container neck.

These objects, and others which will become apparent hereinafter, are attained in accordance with the present invention, by providing a container which has a neck formed with snap-in projections and a closure assembly for attachment to the neck and movable between a fully released position and a fully closed position, with the closure assembly including a screw cap and an index ring which serves as tamper-evident safety mechanism and is connected to the screw cap via several thin bridge portions forming predetermined breaking points and torn off when the screw cap is released from its fully closed position for the first time, whereby the index ring is provided with first locking members and the neck is formed with second locking elements extending radially outwards from the neck at a distance from one another and so interacting with the first locking members that a tightening of the screw cap from the fully released position into an intermediate position results in at least two of the first locking members of the index ring to engage with the second locking members such that a spontaneous unscrewing and release of the screw cap is prevented while still allowing unscrewing of the screw cap by overcoming a certain retention force applied by the first locking members.

The arrangement of such second locking members, preferably at least two ratchets, spaced from one another on the upper rim of the base and projecting radially outwards, enables in a safe and trouble-free manner that the first locking members, preferably at least two elastic flexible tongues, enter a fixed but yet releasable pre-locking disposition when the screw cap is tightened about a certain partial revolution or the screw cap. Thereby, slight drawn film remnants of the severed flash from the mold partition seam cannot adversely affect the pre-locking function in the intermediate position.

Suitably, after slight tightening of the screw cap by about approximately half a screw cap revolution, at least two of the flexible tongues of the index ring so interlock with the ratchets that a spontaneous or self-induced and unintended unscrewing of the screw cap, e.g. through vibrations during transport, is positively prevented while yet allowing to unscrew the screw cap by overcoming the releasable locking action or elastic spring force of the flexible tongues. This ensures that the screw cap can be screwed onto the container into the intermediate pre-locking position for secure transport and protection against dust and can be retained securely in this intermediate position.

Preferably, the upper rim of the neck is formed with twelve radially outwardly projecting ratchets which are spaced evenly from one another for interaction with twelve elastic flexible tongues of the index ring of the closure assembly. This insures that a tightening of the screw cap by about 90° results in already three flexible tongues to interact with the ratchets so as to securely pre-lock the screw cap on the screw thread of the neck. As the ratchets are spaced about the circumference of the neck by a 30° pitch, a turning of the screw cap by slightly more than 90° results in three clicking sounds that are noticeable and audible and forms a sufficiently tight fit of the pre-locked screw cap.

According to another feature of the invention, the index ring, also called "authenticity ring", has an upper rim formed with two diametrically opposing catches for positive engagement in complementary opposite recesses in the lower rim of the screw cap, thereby positively eliminating a noticeable stress or overextension of the thin bridge portions, on the one hand, during tightening of the screw cap into the intermediate pre-locking position and, on the other hand, during tightening of the screw cap into the sealing fully closed position. When the screw cap is unscrewed from the fully closed position for the first time, the thin bridge portions connected to the attached index ring tear off to effect an optically clearly visible separation and distancing of both components as both opposite and coextensive slanted surfaces of the catches at the lower rim of the screw cap and the upper rim of the index ring (or vice versa) slide upon one another, and the index ring is pushed downwards. Thus, even when re-attaching the screw cap, a clearly visible gap remains between the screw cap and the index ring so as to immediately and clearly indicate whether the original seal still exists (originally closed container), or whether the container has been opened (e.g. unauthorized) in the meantime. Persons skilled in the art will understand that the same operation or results are attained when forming the catches at the lower rim of the screw cap, with complementary recess being formed in the upper rim of the index ring, or may also be realized by a combination of both embodiments.

In accordance with still another feature of the present invention, the ratchets terminate in upward direction flush with the surface of the base and jut outwards at their underside at a right angle from the cylindrical outer wall of the base, with at least two, preferably six, ratchets being arranged at the upper end of two, preferably six, circumferential snap-in projections. The undercuts of the projecting ratchets ensure that the sheared-off index ring remains attached to the neck of the screw thread after loosening and unscrewing of the screw cap and is prevented from falling off even in overhead disposition or when subject to shaking of the container.

Advantageously, the index ring remains securely fixed to the screw thread of the neck after unscrewing of the screw cap and thus cannot drop into the subjacent container being filled during emptying of the liquid contents, i.e. during tilting of the container. Also, a secure locking of the index ring during attachment of the screw cap is assured.

BRIEF DESCRIPTION OF THE DRAWING

The above and other objects, features and advantages of the present invention will now be described in more detail with reference to the accompanying drawing in which:

FIG. 5 is a partially sectional illustration of the area of the neck of the container of FIG. 1;

FIG. 6 is a top view of the container neck according to FIG. 5;

FIG. 7 is a fragmentary sectional top view, on an enlarged scale, of the neck area of the container of FIG. 6;

FIG. 8 is a fragmentary sectional view, on an enlarged scale, of the container neck, taken along the line VIII—VIII in FIG. 7;

FIG. 9 is a fragmentary sectional view, on an enlarged scale, of the container neck, taken along the line IX—IX in FIG. 7;

DETAILED DESCRIPTION OF PREFERRED EMBODIMENTS

Figure 1:
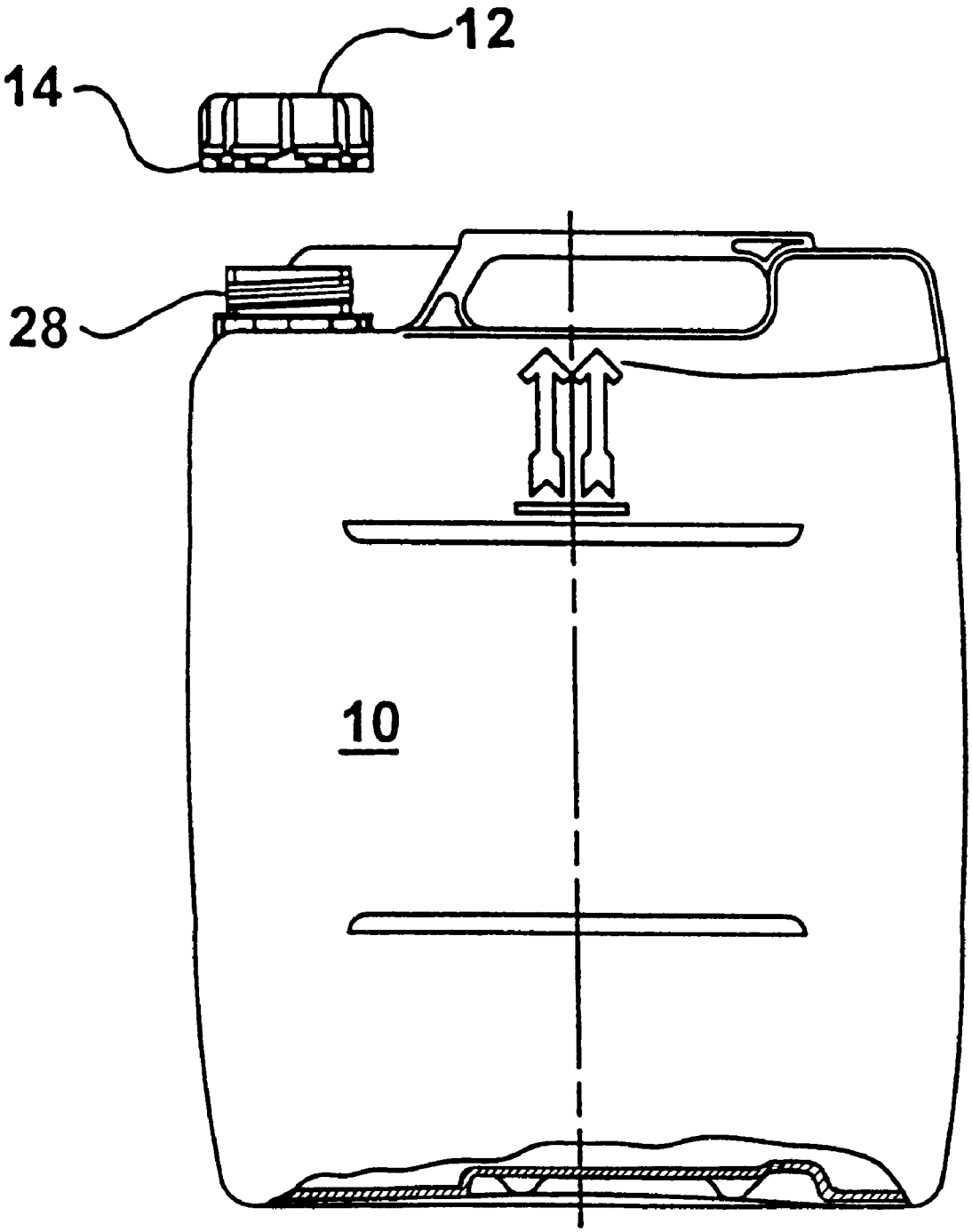
FIG. 1 is a side view of an exemplified container in the form of a plastic canister provided with one embodiment of a closure assembly according to the present invention.

Throughout all the Figures, same or corresponding elements are generally indicated by same reference numerals.

In FIG. 1, reference number 10 designates a plastic canister onto which a closure assembly in the form of a screw cap 12 with integrated injection-molded index ring 14 is to be placed. The single-piece screw cap 12 and the index ring 14 are made of polyethylene (PE) of high molecular weight.

Figure 2:
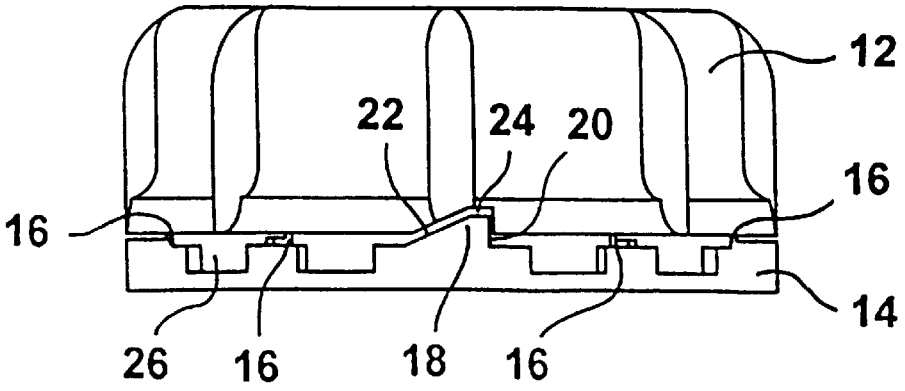
FIG. 2 is a side view of the closure assembly of FIG. 1, showing in detail a screw cap and attached index ring.

As seen from FIG. 2, the index ring 14 is connected to the screw cap 12 only via several—preferably six—extremely thin bridge portions 16 serving as predetermined tear-off breaking points. These bridge portions 16 have a small cross section of only about one square millimeter. Also shown is a projecting catch 18 formed on the index ring 14 with a right-handed vertical stop surface 20 and a left-handed slanted ramp 22. A complementary recess 24 is formed at the lower periphery of the screw cap 12 for receiving the catch 18 in form-fitting manner. In addition, four rectangular continuous indentations 26 are formed starting from the upper periphery of the index ring 14, thereby reducing the height of the interiorly positioned flexible tongues 34. The index ring 14 is formed on its back side in like manner.

Figure 3:
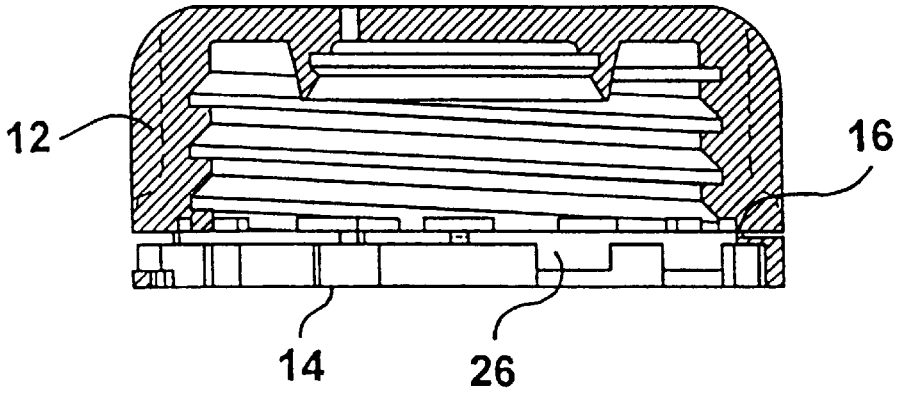
FIG. 3 is a sectional view of the screw cap with index ring.

FIG. 3 shows a sectional view of the screw cap 12 and the index ring 14.

Figure 4:
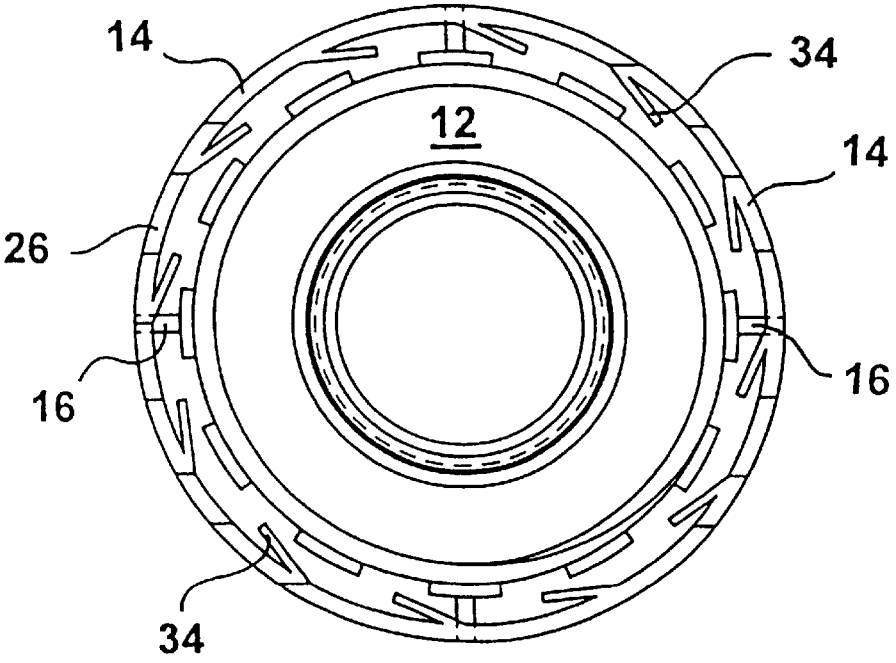
FIG. 4 is a bottom view of the screw cap according to FIG. 2.

FIG. 4 which is a bottom view of the screw cap 12 with index ring 14 illustrates the flexible tongues 34 (=snap-in elements of the index ring) which are slanted in opposition to the unscrewing direction of the screw cap 12, and the thin bridge portions 16 extending between the index ring 14 and the screw cap 12 and serving as predetermined breaking points.

As shown in FIG. 5, the canister 10 has a top surface formed with a neck which includes a base 30 and a screw thread 28. FIG. 6 shows a top view of the container neck. Serrated latching or snap-in projections 32 (=snap-in elements on the container side) pointing in the opening direction are formed along the circumference of base 30. Also seen along the upwardly pointing annular surface of the base 30 are two diametrically opposed axial ratchets or pre-locking cams 36 which project in vertical direction by about two millimeters.

FIG. 7 shows in more detail an enlarged view of the snap-in projections 32 and ratchets 36. FIG. 8 and FIG. 9 are sectional views taken along the lines VIII—VIII and IX—IX in FIG. 7 to show the arrangement of the axial ratchets 36 on the top side of base 30 and the outwardly extending edge projection 38 encircling the upper edge of the base 30, behind which the flexible tongues 34 of the index ring 14 engage, thereby preventing the sheared-off index ring 14 from falling off.

Figure 10:
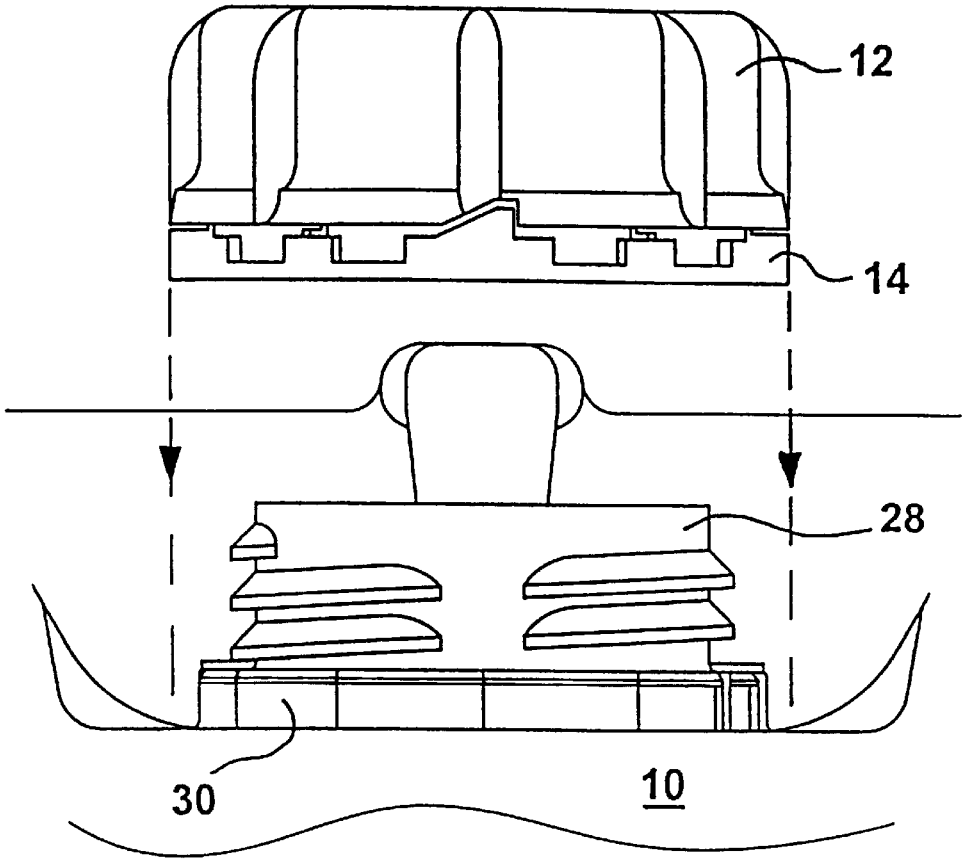
FIG. 10 is an exploded illustration of the closure assembly, showing the screw cap before attachment upon the neck.

After having described the individual elements of the closure assembly, its mode of operation will now be explained with respect to FIGS. 10 to 15:

Shown in FIG. 10 is the screw cap 12 with index ring 14 which is to be screwed onto the screw thread 28 of a canister.

Figure 11:
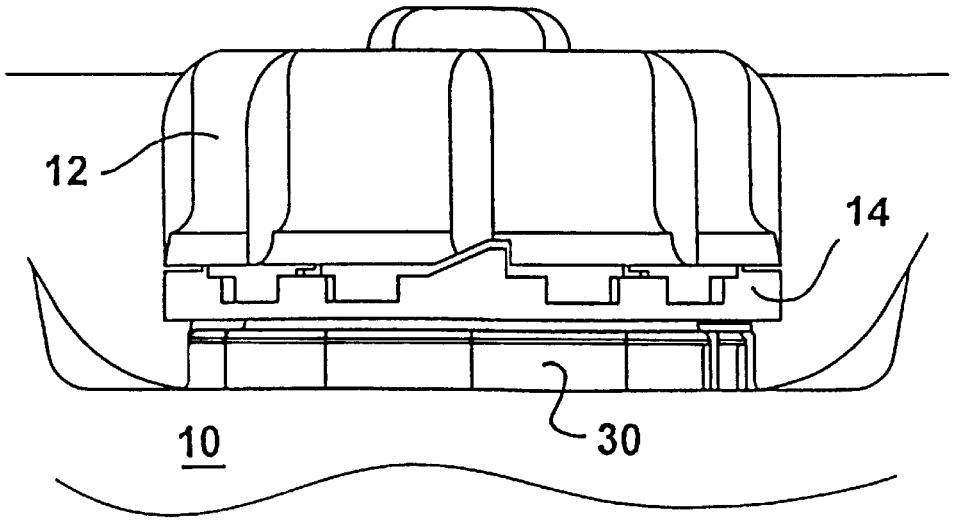
FIG. 11 is a schematic side view of the closure assembly, showing the screw cap tightened on the neck into the intermediate pre-locking position.

In FIG. 11, the screw cap 12 is already screwed onto the screw thread 28 of the neck and tightened to occupy the intermediate, still releasable pre-locking position.

The pre-locking position of the screw cap 12 with the index ring 14 is safely accomplished by the first flexible tongues 34 or snap-in lamellа of the index ring 14 in conjunction with the two ratchets 36 which project axially by about 1 to 2 mm and are located on the upwardly or obliquely upwardly pointing ring surface of the base 30 of the neck. When the container 10 is closed and the screw cap 12 is screwed on, one or two flexible tongues 34 interact with the ratchets 36 after between one half turn and one turn. The elastic flexible tongues 34 of the index ring 14 are then twisted beyond these ratchets 36 by applying only a slight torque and latch or spring back therebehind into their normal position. In this way, the screw cap 12 is protected against turning or spontaneous loosening as a result of vibrations or shock during transport, without experiencing a significant stress which could result in a tearing off of the bridge portions 16 that form the predetermined breaking points.

Figure 12:
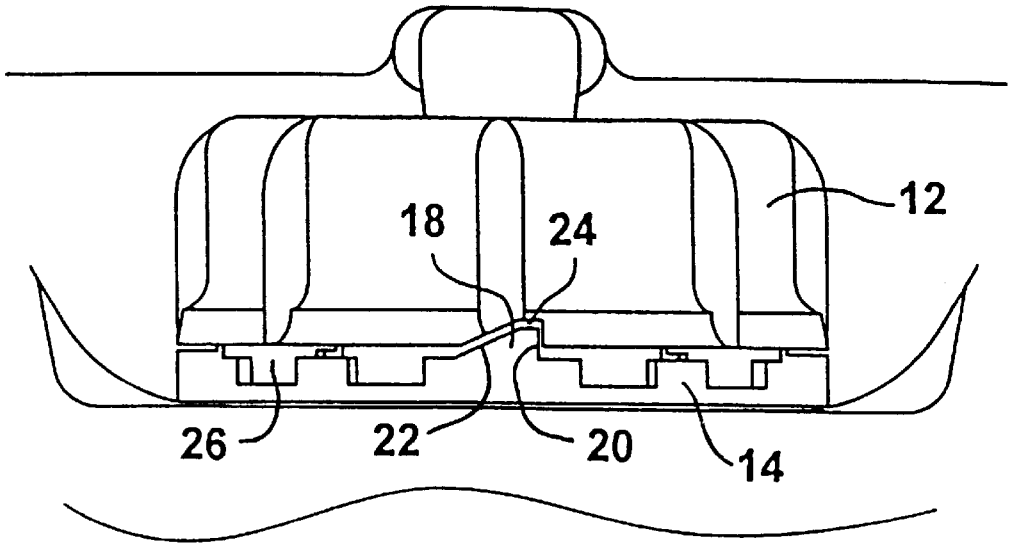
FIG. 12 is a schematic side view of the closure assembly, showing the screw cap tightened on the neck into the fully closed position.

This is possible—as seen from FIG. 12—by the special configuration of both catches 18 on the upper edge of the index ring 14 which engage in corresponding recesses 24 in the lower periphery of the screw cap 12. When the screw cap 12 is tightened, the right-hand vertical stop surface 20 of the catches 18 moves against the complementary vertical stop surface of the screw cap 12, and a large torque can be transmitted without unduly strain upon the bridge portions 16, in particular when the screw cap 12 is tightened into its gas-tight and liquid-tight fully closed sealing position.

When the screw cap 12 is loosened or unscrewed, the flat bevel of the periphery of the screw cap 12 moves against the corresponding left-hand slanted ramp surface 22 of the catch 18. Not only is the index ring 14 circumferentially held by the flexible tongues 34 which are locked behind the snap-in projections 32 spaced about the perimeter of the base 30, but the index ring 14 is also pressed away axially from the screw cap 12 as a result of the sliding motion of the two beveled surfaces, whereby the predetermined breaking points and the thin bridge portions 16, respectively, are positively severed.

Figure 13:
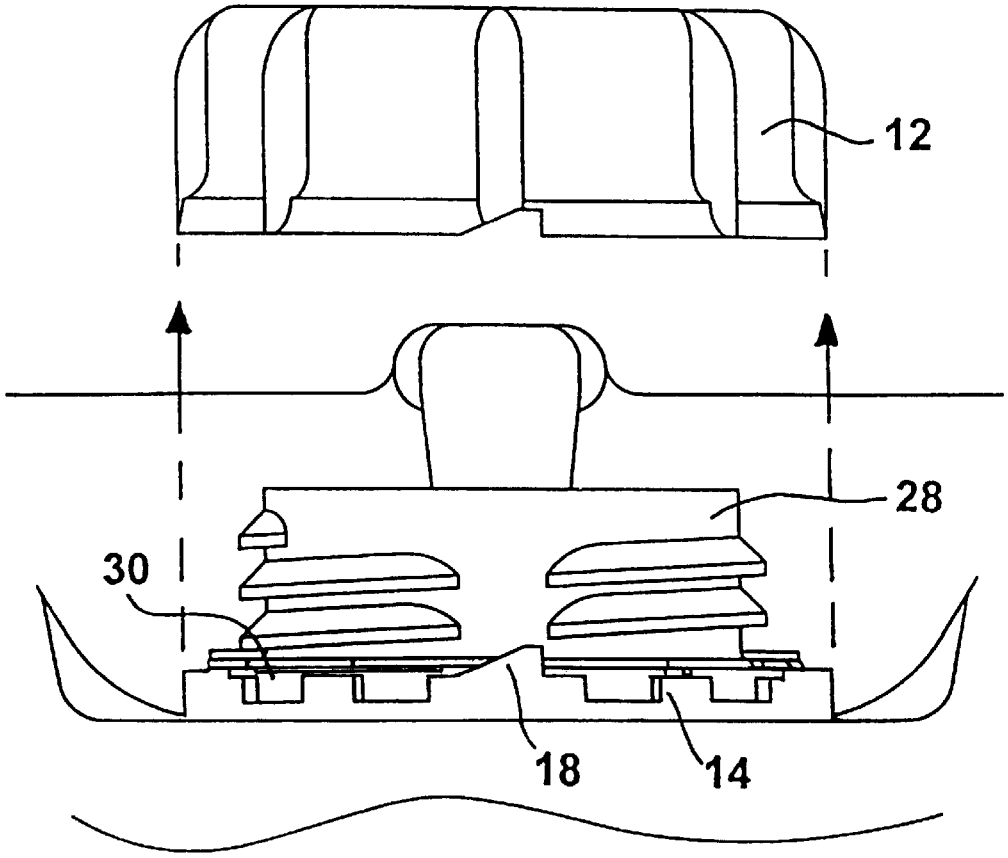
FIG. 13 is a schematic side view of the closure assembly, showing the screw cap being unscrewed from the fully closed position and the sheared-off index ring remaining attached upon the neck.

This is shown in FIG. 13: after unscrewing the screw cap 12 and after severing the predetermined breaking points, the index ring 14 remain on the base 30, since the flexible tongues 34 with their reduced height (in the area of the rectangular indentations 26) engage in form-fitting manner behind the axially protruding circumferential edge projections 38, thereby securely preventing that the index ring 14 becomes detached or drops, even when the container 10 is tipped over or shaken.

Figure 14:
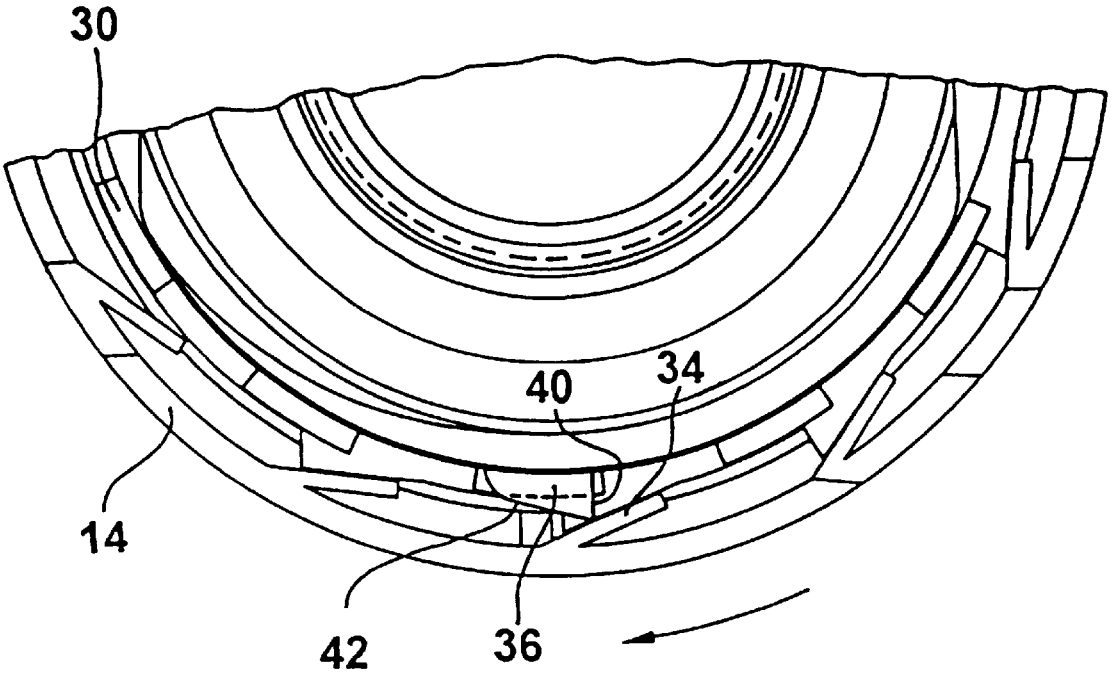
FIG. 14 is a fragmentary, schematic illustration, on an enlarged scale, of the index ring just before occupying the intermediate pre-locking position.

FIG. 14 shows and explains once more how the screw cap 12 is locked in the intermediate pre-locking position. When the screw cap 12 is screwed on for the first time, after by about one turn of the screw cap, the first flexible tongue 34 interacts with the ratchets 36. The same occurs on the opposite side of base 30. The flexible tongues 34 are elastically deformed outwards and slide across the right-hand steep surface 40 of the ratchet 36, until they spring back therebehind into their normal position for securing the screw cap 12 against unintended loosening.

Figure 15:
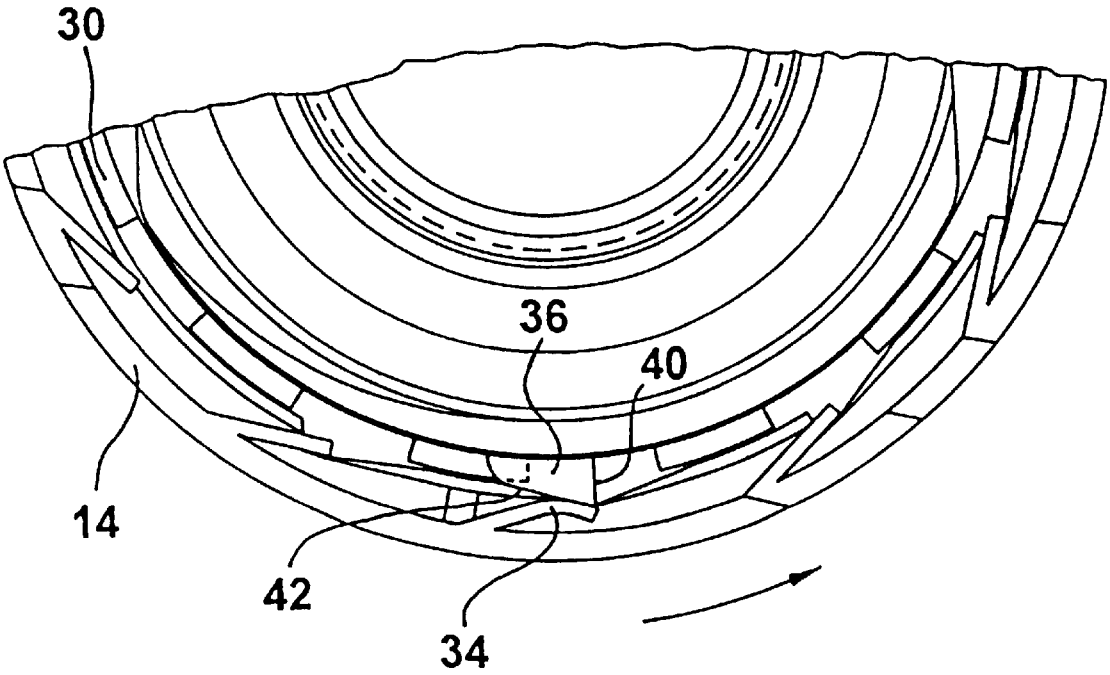
FIG. 15 is a fragmentary, schematic illustration, on an enlarged scale, of the index ring of FIG. 14 upon release from the intermediate pre-locking position.

When the screw cap 12 is loosened from the pre-locking position, the flexible tongue 34 slides—as shown in FIG. 15—elastically across the left hand beveled edge 42. The left edge 42 of the ratchet 36 has a flat or oblique shape to prevent an upsetting of the flexible tongues. Thus, a release from the pre-locked position is simply effected by overcoming the elastic spring force of only one or several flexible tongues 34.

As mentioned above, the embodiment according to the invention can be equally implemented by using a bung plug, e.g. for a bunged drum.

Figure 16:
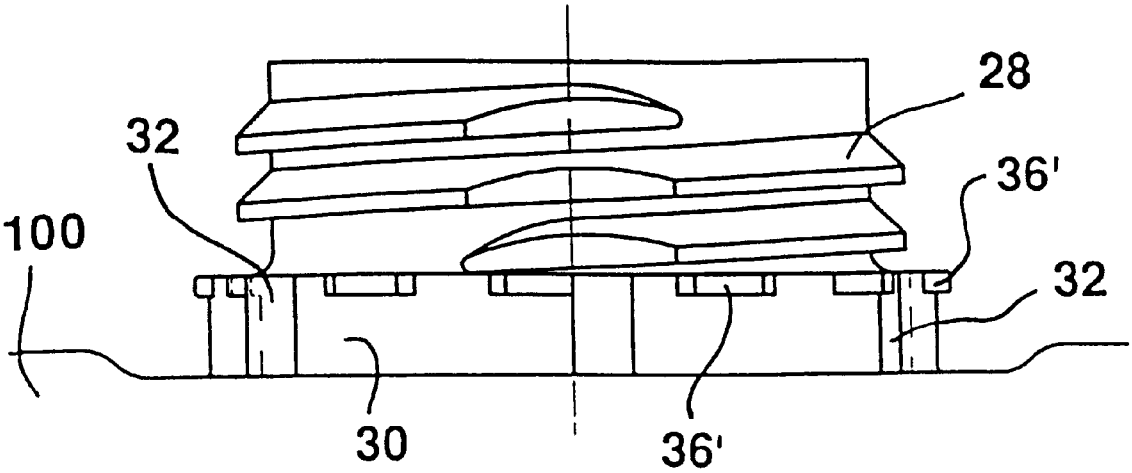
FIG. 16 is a schematic side elevational view of a neck with screw thread of a second embodiment of a container according to the invention.

Turning now to FIG. 16, there is shown a schematic side elevational view of a second embodiment of a container 100 according to the invention, showing in detail the container neck with base 30 and screw thread 28 for interaction with the screw cap 12 which has the injection molded index ring 14 attached thereon. The single-piece screw cap 12 and the index ring 14 are made of highly molecular polyethylene (PE). The index ring 14 is connected with the screw cap 12 via several, extremely thin bridge portions 16—preferably six—serving as tear-off predetermined breaking points and having a small cross section of only about one square millimeter (see FIG. 2).

The screw cap 12 for use with container 100 is of same configuration as shown in FIG. 2 and includes the catch 18 projecting upwardly from the index ring 14 and formed with the right hand vertical stop surface 20 and the left hand slanted slide down ramp 22. The lower edge of the screw cap 12 is formed with a complementary recess 24 for engagement in a form-fitting manner of the catch 18. The upper rim of the index ring 14 is further traversed by four rectangular indentations 26 by which the height of the inner flexible tongues 34 is reduced. The backside of the index ring 14 is designed in a same manner. Both catches 18 at the upper rim of the index ring 14 engage in respective recesses 24 in the lower rim of the screw cap 12. When tightening the screw cap 12, the right hand vertical stop surface 20 of the catch 18 impacts against the respectively configured vertical stop surface of the screw cap 12, and great torque can be transmitted, in particular during firm closing of the screw cap 12 into their gas-tight and liquid-tight fully closed position, without subjecting the bridge portions 16 to a noticeable stress.

When loosening or unscrewing the screw cap 12, the flat slanted surface of the screw cap rim moves on the respective left hand slanted ramp 22 of the catch 18. In addition to the circumferential securement of the index ring 14 by the flexible tongues 34 that lock behind the snap-in projections 32 on the base perimeter, the gliding of both slanted surfaces upon one another results in an axial push of the index ring 14 away from the screw cap 12 to thereby effect a secure severing of the predetermined breaking points in the form of the thin bridge portions 16.

Figure 17:
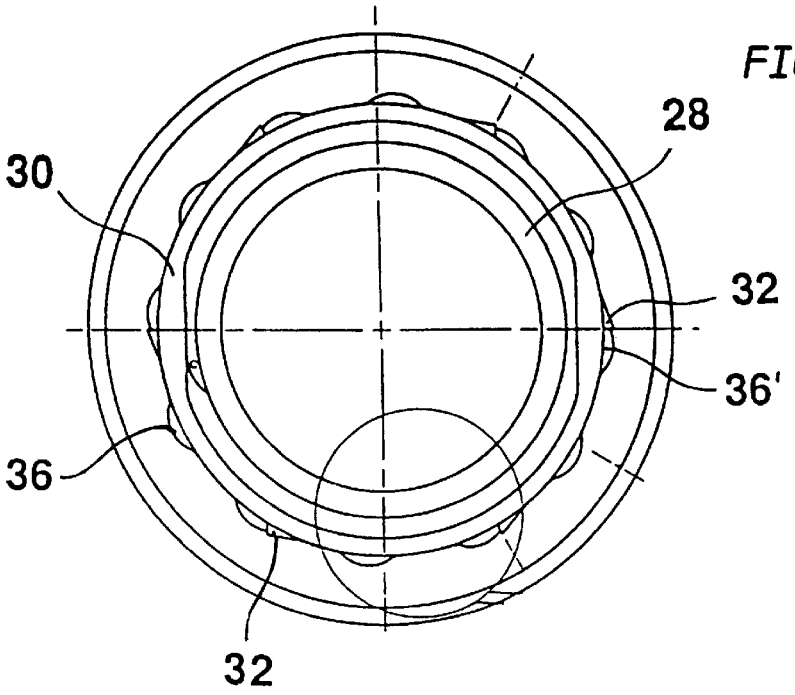
FIG. 17 is a top view of the neck according to FIG. 16.
Figure 18:
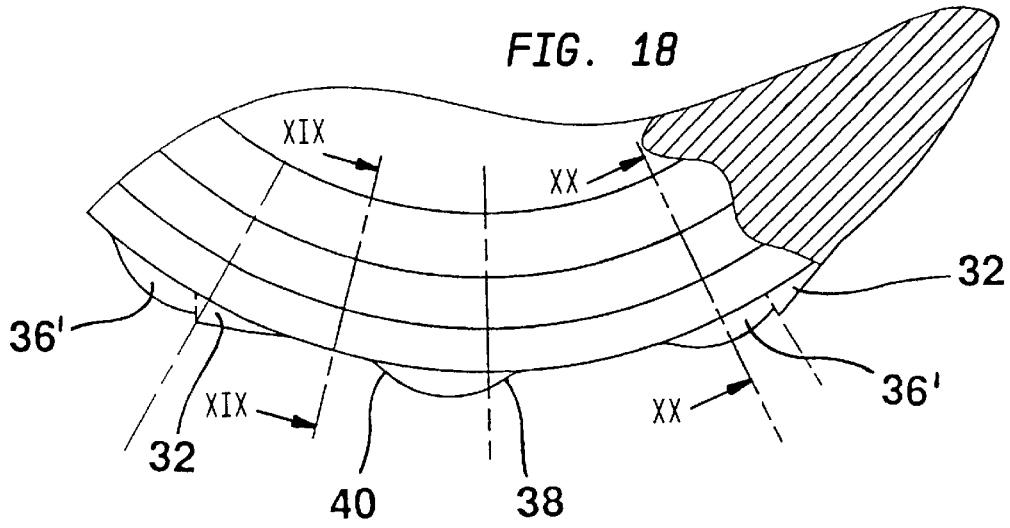
FIG. 18 is a fragmentary sectional top view, on an enlarged scale, of the neck area of the container of FIG. 14, taken along the line XVIII—XVIII in FIG. 20.

FIG. 17 is a side view of the screw thread 28 of the container 100 with lower base 30, and FIG. 18 shows a top view thereof. The base 30 is formed about its outer perimeter with six serrated snap-in projections 32 (=snap-in elements on the container side) pointing in unscrewing direction and configured as continuous vertical webs. The upper outer rim of the base 30 is further provided with twelve radially outwardly projecting ratchets or pre-locking cams 36', with the ratchets 36' having a vertical height of about 1.5 mm to 2.5 mm, preferably about 1.8 mm, and a radial extension, as measured from the cylindrical outer wall of the base 30, of about 1.0 mm to 2.5 mm, preferably of about 1.5 mm.

Although the provision of twelve such ratchets 36' is a preferred embodiment, it is also possible to provide less than twelve ratchets 36'; However, at least, two such ratchets 36' need to be provided in order to effect attain a secure pre-locking of the screw cap 12, as will be described hereinafter.

FIG. 18 again illustrates these snap-in projections 32 and the ratchets 36' , on an enlarged scale.

Figure 19:
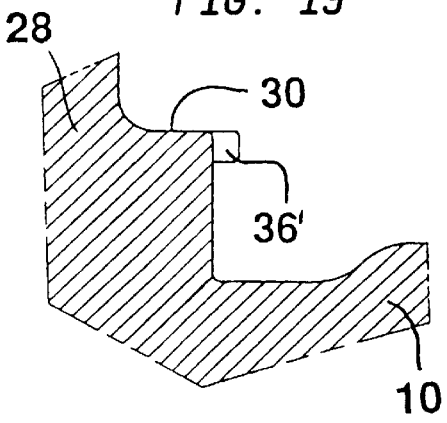
FIG. 19 is a fragmentary sectional view, on an enlarged scale, of the container neck, taken along the line XIX—XIX in FIG. 18.
Figure 20:
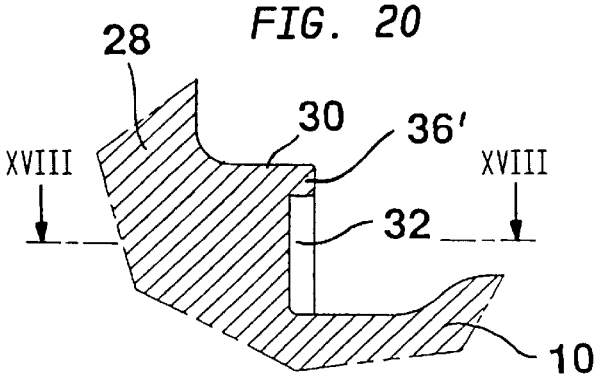
FIG. 20 is a fragmentary sectional view, on an enlarged scale, of the container neck, taken along the line XX—XX in FIG. 18.

FIG. 19 shows a sectional view taken along the line XIX—XIX in FIG. 18, and FIG. 20 shows a sectional view taken along the line XX—XX in FIG. 18, to illustrate the arrangement of the ratchets 36' on the upper side of the base 30 at the upper end of the snap-in projections 32, for engagement of the flexible tongues 34 of the index ring 14 to prevent a detachment of the sheared-off index ring 14.

After having described the individual elements of the closure assembly for use with container 100, its mode of operation will now be explained:

The manufacturer in the packaging industry provides a suitably designed container 100, with the screw cap 12 including the index ring 14 being screwed onto the screw thread 28 from the fully released position into the intermediate pre-locking position.

The secure pre-locking action of the screw cap 12 with index ring 14 is effected by at least two, preferably by all flexible tongues 34 of the index ring 14 in conjunction with at least two, preferably twelve, radially outwardly projecting ratchets 36' on the cylindrical outer wall of the neck base 30. During slight closing of the container 100 by tightening the screw cap 12 from the fully released position into the intermediate pre-locking position, at least two or more (maximum all twelve) flexible tongues 34 interact with the ratchets 36' after about a quarter to a half revolution of the screw cap 12. The elastic flexible tongues 34 of the index ring 14 are turned at slight torque over the ratchets 36', with the resilient tongues 34 elastically bending outwards and sliding via the right hand flat slanted ramp 40 of the ratchet 36' until springing back and locking therebehind into their normal position. This establishes the intermediate pre-locking position of the screw cap 12 which is secured in an optimum manner for transport against rotation and against an unintended, self-induced loosening through shocks and vibrations, without encountering a substantial stress and possible tearing of the bridge portions 16 that form the predetermined breaking points.

At the filling station, the screw cap 12 is unscrewed from the pre-locking position and removed from the container 100. When the screw cap 12 is released from the pre-locking position, the resilient tongues 34 slide elastically over the left hand flat slanted ramp 42. The slanted ramp 42 of the ratchet 36' is of such flat configuration and so slantingly designed as to prevent an upsetting of the tips of the flexible tongues 34. The release from the pre-locking position thus requires the user to only overcome the elastic spring force of two or more flexible tongues 34.

After the container 100 is filled at the filling station, the screw cap 12 is securely tightened upon the container 100, and the flexible tongues 34 snap non-releasably behind the circumferential, serrated snap-in projections 32. The screw cap 12 can then only be loosened and unscrewed by tearing-off the index ring 14. After unscrewing the screw cap 12 from the fully sealed closing position and tearing off the predetermined breaking points, the index ring 14 remains secured to the base 30, because the flexible tongues 34 engage in a form-fitting manner behind the radially projecting underside of the ratchets 36'. A detachment or drop of the index ring 14 is thus positively prevented even when the container 100 is in overhead disposition and subject to shaking.

The screw cap according to the invention may be provided with separately prefabricated and attached index ring. In accordance with a preferred embodiment, the screw cap together with the integrated injection-molded index ring may be made in single piece configuration from highly molecular polyethylene (PE) and thus meets all standards necessary for approval and exhibits good strength properties at low temperature. Functionality of the pre-locking action and retention of the sheared-off index ring upon the screw thread presumes a functional interaction of screw cap and screw thread.

While the invention has been illustrated and described as embodied in a container with tamper-evident and pre-lockable closure assembly, it is not intended to be limited to the details shown since various modifications and structural changes may be made without departing in any way from the spirit of the present invention.

what is claimed as new and desired to be protected by letters patent is set forth in the appended claims:

1. A container, comprising:

a main body having a top provided with a neck formed with threads and snap-in projections; and a closure assembly having complementary threads for attachment to the neck, said closure assembly being rotatably movable by neck threads and closure assembly threads to a fully released position and then further rotatably movably to fully closed position, said closure assembly including a screw cap, and an index ring connected to the screw cap via bridge portions and formed with flexible first locking members, the first locking members engage behind the snap-in projections such that the bridge portions are severed when the screw cap is unscrewed from the fully closed position, wherein said neck is provided with at least two second locking members extending radially outwards from the neck at a distance from one another for interacting with at least two of the first locking members of the index ring in the fully released position such that a spontaneous unscrewing and release of the screw cap is prevented while still allowing unscrewing of the screw cap by overcoming a certain retention force applied between the second locking members and the first locking members.

2. The container of claim 1 wherein the neck includes a base having an upper rim, located below the threads, said snap-in projections being formed on the base, with the second locking members being connected to the base at the upper rim thereof.

3. The container of claim 2 wherein at least four such second locking members are formed at the upper rim of the base and spaced evenly from one another for mutual engagement with at least four such first locking members of the index ring.

4. The container of claim 2 wherein at least six such second locking members are formed at the upper rim of the base and spaced evenly from one another for mutual engagement with at least six such first locking members of the index ring.

5. The container of claim 2 wherein at least twelve such second locking members are formed at the upper rim of the base and spaced evenly from one another for mutual engagement with at least twelve such first locking members of the index ring.

6. The container of claim 1 wherein the second locking members, when viewed from a top plan view, are shaped in the form of a graduated circle with a slanted first ramp and a slanted second ramp, said first locking members of the index ring extending slantingly rearwardly in unscrewing direction so as to slide over the first ramp and positively engage behind the second locking members when in the fully release position, and to slide elastically over the second ramp of the locking members when unscrewing the screw cap from the fully released position by overcoming a spring force of the first locking members against the second ramp.

7. The container of claim 1 wherein the second locking members have a vertical height of about 1.5 mm to 2.5 mm.

8. The container of claim 7 wherein the second locking members have a vertical height of about 1.8 mm.

9. The container of claim 7 wherein the neck includes a base having an upper rim located below the threads, the second locking members being connected to the base at the upper rim thereof, said second locking members having a radial extension, as measured from a cylindrical outer wall of the base, of about 1.0 mm to 2.5 mm.

10. The container of claim 9 wherein the second locking members have a radial extension of about 1.5 mm.

11. The container of claim 1 wherein the neck includes a base having an upper rim located below the threads, the second locking members being connected to the base at the upper rim thereof, said second locking members terminating in an upward direction flush with an upper surface of the base and jut outwards at their underside at a right angle from a cylindrical outer wall of the base.

12. The container of claim 1 wherein two said second locking members are respectively arranged at the upper end of two said circumferential snap-in projections.

13. The container of claim 1 wherein six said second locking members are arranged at the upper end of six said circumferential snap-in projections.

14. The container of claim 1 wherein the index ring is formed with at least one upwardly projecting catch formed on a upper rim of the index ring for engagement in an opposing complementary recess formed in a lower edge of the screw cap.

15. The container of claim 14 wherein the catch is provided on one side with a steep stop surface and on another side with a slanted or flat slide-off ramp, with the opposing recess being of complementary configuration.

16. The container of claim 1 wherein the index ring is formed with a plurality of upwardly projecting catches formed on an upper rim of the index ring for engagement in in a same number of diametrically opposing complementary recesses formed in a lower edge of the screw cap.

17. The container of claim 1 wherein the neck includes a base defined by a perimeter, said second locking members extending radially outwards from the perimeter of the base and having an underside which is engaged therebehind in a form-fitting manner by the first locking members when the screw cap is tightened into its fully closed position, with the first locking members extending radially inwardly at an acute angle.

18. A container, comprising:

a main body having a top provided with a fill stub (28) which is formed with threads and protrusions (32);

a screw cap (12) having complementary threads; and an index ring (14) serving as an authenticity seal and attached to the screw cap via thin connecting webs (16), said index ring having flexible locking members (34) to engage nondetachably behind the protrusions (32) such that the connecting webs (16) acting as predetermined breaking points, are severed when the screw cap is released from a fully closed position in which the container is sealed by the screw cap, said fill stub being provided with at least one cam (36) for a preliminary engagement of the screw cap on the fill stub (28) by at least one of the locking members (34) when the container is still empty and the screw cap has not yet reached the fully closed position, thereby preventing a spontaneous unscrewing and release of the screw cap (12) while still allowing the screw cap (12) to be released for filling the container by overcoming a certain holding force between the at least one cam and the at least one of the locking members (34), the preliminary engagement of the screw cap on the fill stub by the at least one cam and the at least one of the locking members occurring before the locking members nondetachably engage behind the protrusions (32) to seal the filled container.

* * * * *